US010511108B1

(12) United States Patent
Wu

(10) Patent No.: US 10,511,108 B1
(45) Date of Patent: Dec. 17, 2019

(54) DUAL-WIRE CONNECTOR

(71) Applicants: DINKLE ENTERPRISE CO., LTD., New Taipei (TW); DINKLE ELECTRIC MACHINERY (CHINA) CO., LTD., Kunshan, Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 16/241,667

(22) Filed: Jan. 7, 2019

(51) Int. Cl.
*H01R 9/24* (2006.01)
*H01R 4/48* (2006.01)

(52) U.S. Cl.
CPC ..... *H01R 9/2416* (2013.01); *H01R 4/4836* (2013.01); *H01R 9/2408* (2013.01); *H01R 4/4827* (2013.01)

(58) Field of Classification Search
CPC ..... H01R 4/48; H01R 4/4827; H01R 4/4836; H01R 9/2408; H01R 9/2416; H01R 11/05; H01R 11/09; H01R 12/515
USPC ..... 439/540.1
See application file for complete search history.

(56) References Cited

U.S. PATENT DOCUMENTS 6,146,187 A * 11/2000 Pallai ..... H01R 4/4836 439/431
9,397,444 B1 * 7/2016 Wu ..... H01R 4/4845
9,466,894 B2 * 10/2016 Wu ..... H01R 4/4836
9,466,897 B1 * 10/2016 Wu ..... H01R 9/2491
9,466,911 B1 * 10/2016 Wu ..... H01R 4/4836
9,502,795 B1 * 11/2016 Wu ..... H01R 4/4827
9,705,212 B1 * 7/2017 Wu ..... H01R 9/26
10,014,594 B1 * 7/2018 Wu ..... H01R 4/4827
10,267,981 B1 * 4/2019 Wu ..... G02B 6/0088
(Continued)

FOREIGN PATENT DOCUMENTS

CN 206180139 U 5/2017
DE 102006005260 A1 8/2007
EP 3306750 A1 4/2018

OTHER PUBLICATIONS

Office Action dated Sep. 19, 2019 of the corresponding German patent application.

*Primary Examiner* — Edwin A. Leon
*Assistant Examiner* — Milagros Jeancharles
(74) *Attorney, Agent, or Firm* — Chun-Ming Shih; HDLS IPR Services

(57) ABSTRACT

A dual-wire connector (1) includes: an insulation base (10), having a base plate (11) and an enclosing plate (12) formed with two insertion ports (121); an electric conductive terminal (20), fastened on the base plate (11), and having a first lateral plate (211) and a second lateral plate (212); a first electric conductive elastic sheet (30), electrically connected to the electric conductive terminal (20); a second electric conductive elastic sheet (40), separately arranged with respect to the first electric conductive elastic sheet (30), electrically connected to the electric conductive terminal (20); and a pressing member (50), moveably connected to the base plate (11) and having insertion slots (53) corresponding the two insertion ports (121) and a pushing unit (52) formed at one side of the insertion slot (53). Accordingly, the stability and the tightness while being clamped can be enhanced.

13 Claims, 7 Drawing Sheets

(56) References Cited

U.S. PATENT DOCUMENTS

2010/0081316 A1* 4/2010 Eppe ..... H01H 1/5844
439/441

* cited by examiner

DUAL-WIRE CONNECTOR

BACKGROUND OF THE INVENTION

Field of the Invention

The present invention relates to a connector technology, especially to a dual-wire connector.

Description of Related Art

A conventional dual-wire connector mainly includes an insulation base, an electric conductive terminal and an electric conductive elastic sheet, wherein the electric conductive elastic sheet is mostly integrally formed, so that the mold structure is complicated and the development cost is very high; also, in the manufacturing process, a lot of materials would be wasted, so that the production cost cannot be effectively lowered thereby affecting the practicability. The integrally-formed electric conductive elastic sheet can only be applied in a finished product with single specification, thereby not being flexible in applications; moreover, an interfering situation may happen during the operation process, so that the stability and tightness while being clamped are greatly reduced.

Accordingly, the applicant of the present invention has devoted himself for improving the mentioned disadvantages.

SUMMARY OF THE INVENTION

The present invention is to provide a dual-wire connector, in which a first electric conductive elastic sheet and a second electric conductive elastic sheet are separately arranged, so that there is no interference, and the stability and the tightness while being clamped can be enhanced.

Accordingly, the present invention provides a dual-wire connector including an insulation base, an electric conductive terminal, a first electric conductive elastic sheet, a second electric conductive elastic sheet and a pressing member; the insulation base has a base plate and an enclosing plate extended from the base plate, and two insertion ports are formed on the enclosing plate; the electric conductive terminal is fastened on the base plate, and has a first lateral plate and a second lateral plate; the first electric conductive elastic sheet has a fastening segment and a clamping segment, the fastening segment is electrically connected to the electric conductive terminal, and the clamping segment is formed at one side of the first lateral plate; the second electric conductive elastic sheet is separately arranged with respect to the first electric conductive elastic sheet and has a fastening segment and a clamping segment, the fastening segment is electrically connected to the electric conductive terminal, and the clamping segment is formed at one side of the second lateral plate; the pressing member is moveably connected to the base plate and has insertion slots corresponding the two insertion ports and a pushing unit formed at one side of the insertion slot, wherein through pressing the pressing member for allowing the pressing member to be displaced, the pushing units are able to push the clamping segments so as to be released.

In comparison with related art, the present invention has advantageous features as follows. The first electric conductive elastic sheet and the second electric conductive elastic sheet can be served to replace each other, so that the expenditure for fabricating mold and the production cost can be saved. The first electric conductive elastic sheet and the second electric conductive elastic sheet are detachably connected to the electric conductive terminal, so that the electric conductive terminal or the electric conductive elastic sheets having different specifications can be adopted according to the requirements of different currents, thereby being flexible in applications. The first electric conductive elastic sheet and the second electric conductive elastic sheet can be operated by the single pressing member, so that the efficiency of connecting wires and removing wires can be increased and more conveniences are provided in operations.

DETAILED DESCRIPTION OF THE INVENTION

Preferred embodiments of the present invention will be described with reference to the drawings.

Figure 1:
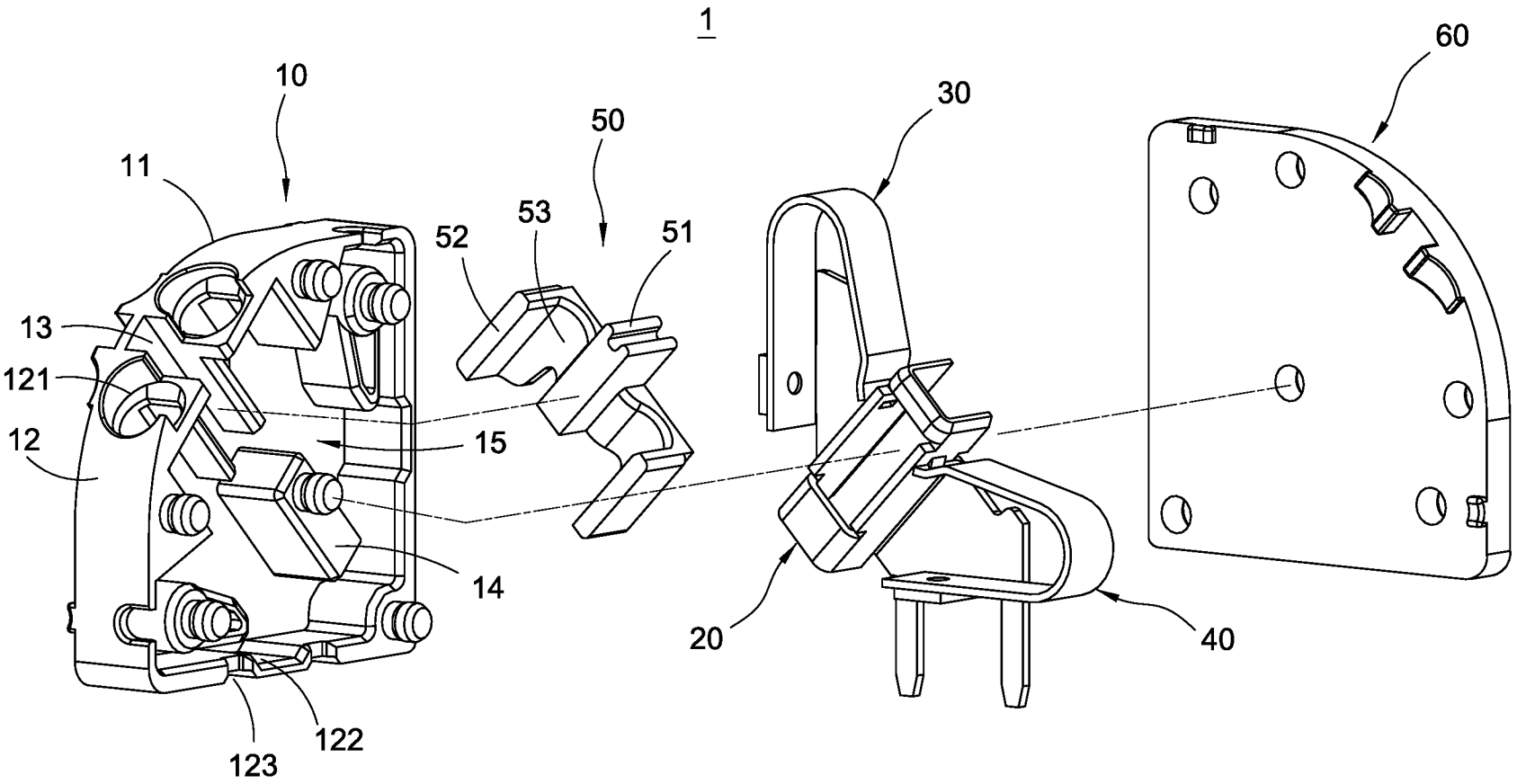
FIG. 1 is a perspective exploded view showing a dual-wire connector according one embodiment of the present invention.
Figure 2:
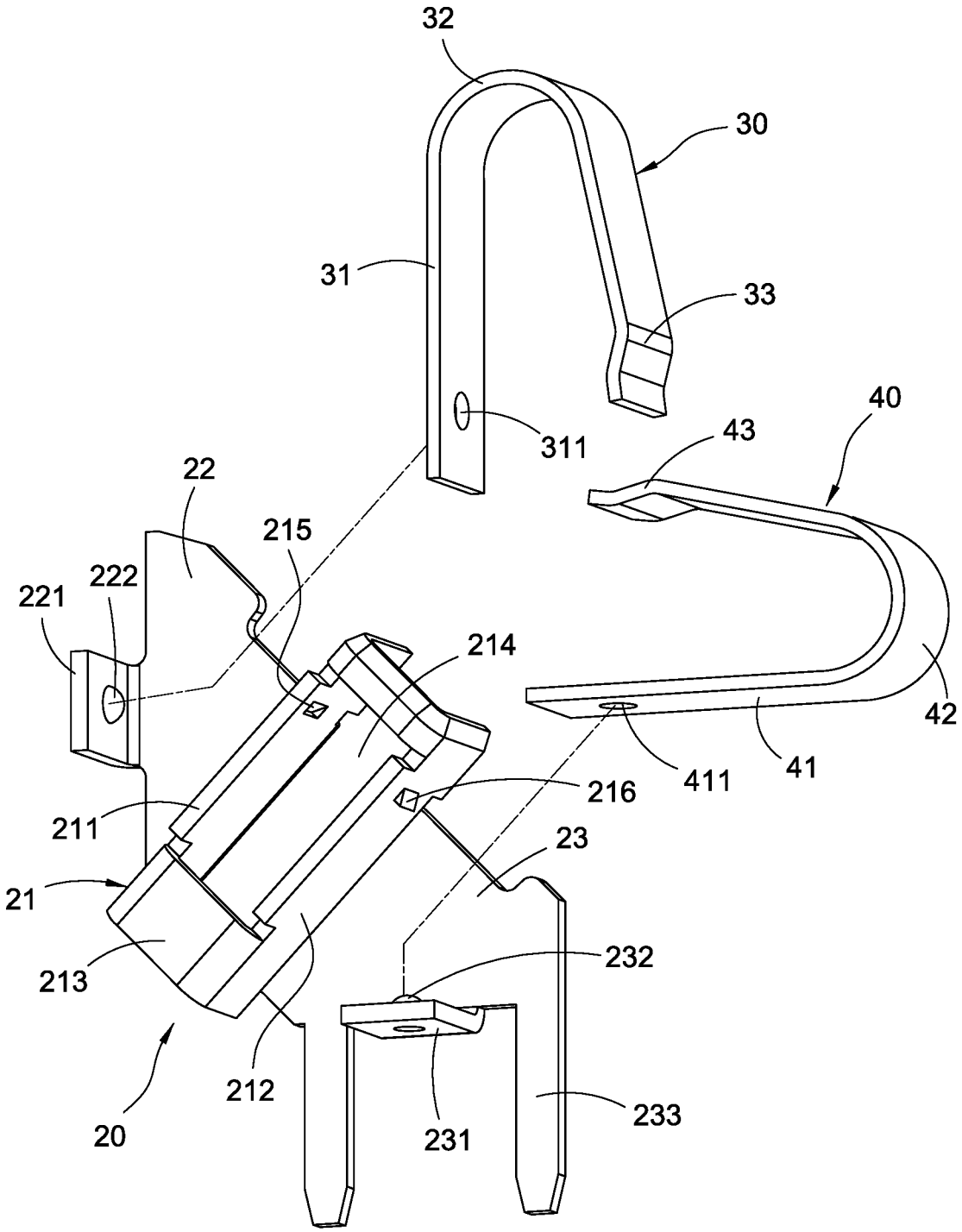
FIG. 2 is a perspective exploded view showing the electric conductive terminal and the electric conductive elastic sheets according one embodiment of the present invention.
Figure 3:
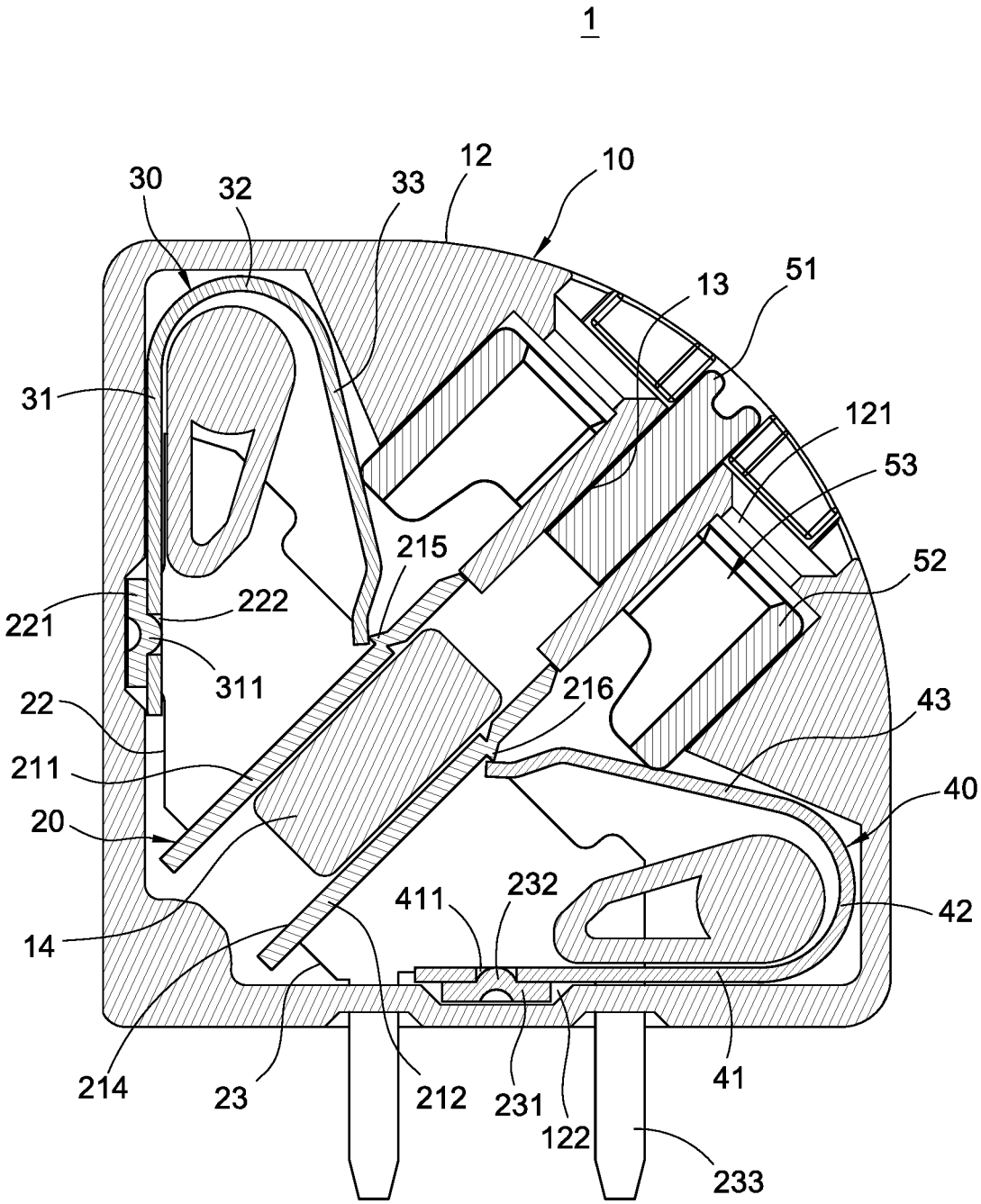
FIG. 3 is a cross sectional view showing the assembly of the dual-wire connector according one embodiment of the present invention.

Please refer from FIG. 1 to FIG. 3, a dual-wire connector 1 mainly including an insulation base 10, an electric conductive terminal 20, a first electric conductive elastic sheet 30, a second electric conductive elastic sheet 40 and a pressing member 50 is disclosed in the present invention.

The insulation base 10 mainly had a base plate 11 and an enclosing plate 12 bent and extended from a periphery of the base plate 11, the base plate 11 is formed as a quarter-round plate, two insertion ports 121 are formed on the enclosing plate 12 and spaced with an interval, a guide channel 13 is formed between the two insertion ports 121, a fastening block 14 is formed corresponding to a distal end of the guide channel 13, two sides of the fastening block 14 are formed with an elastic sheet accommodating zone 15, mounting slots 122 are formed on the enclosing plate 12 at locations corresponding to the elastic sheet accommodating zones 15, and two penetrated slots 123 penetrating the enclosing plate 12 are formed in one of the mounting slots 122.

The electric conductive terminal 20 can be made of a metal material having an excellent electric conductivity, for example a spring steel, and fastened on the base plate 11 of the insulation base 10. According to this embodiment, the electric conductive terminal 20 is formed in a butterfly-like shape, and mainly includes a seat member 21, a left planar plate 22 and a right planar plate 23, the cross section of the seat member 21 is formed in a U-like shape, and mainly includes a first lateral plate 211, a second lateral plate 212 arranged corresponding to the first lateral plate 211 and a connection plate 213 used for connecting the first lateral plate 211 and the second lateral plate 212, a through slot 214 is formed on the connection plate 213, the through slot 214 is sleeved and fastened corresponding to the fastening block 14, a latching block 215 is formed on the first lateral plate 211 with a punching means, and a latching block 216 is formed on the second lateral plate 212 with a punching means.

The left planar plate 22 and the right planar plate 23 are formed through being outwardly extended from the first lateral plate 211 and the second lateral plate 212, the left planar plate 22 and the right planar plate 23 are both formed in a stepped status, a left mounting block 221 is bent and extended from one side of the left planar plate 22, a protrusion 222 is formed on a distal end surface of the left mounting block 221, the left mounting block 221 is mounted and positioned corresponding to the mounting slot 122. A right mounting block 231 is bent and extended from one side of the right planar plate 23, a protrusion 232 is formed on a distal end surface of the right mounting block 231, a pair of insertion pins 233 are extended from the right planar plate 23 at the side where the right mounting block 231 is disposed, the right mounting block 231 is mounted and positioned corresponding to the mounting slot 122, and the insertion pins 233 are protruded from the penetrated slots 123 so as to be exposed outside the insulation base 10.

The first electric conductive elastic sheet 30 can be made of a metal material having an excellent electric conductivity, for example a copper alloy, and a surface thereof can be protected by a nickel layer or a zinc layer formed through a lead-free electroplating means. The first electric conductive elastic sheet 30 is detachably connected to the electric conductive terminal 20. The first electric conductive elastic sheet 30 is accommodated in the elastic sheet accommodating zone 15 and mainly has a fastening segment 31, a bending segment 32 extended from the fastening segment 31 and a clamping segment 33 extended from the bending segment 32, a through hole 311 is formed at the fastening segment 31, the through hole 311 is latched and positioned corresponding to the protrusion 222 and electrically connected to the electric conductive terminal 20, and the clamping segment 33 is formed at one side of the first lateral plate 211 and abutted against the latching block 215.

The second electric conductive elastic sheet 40 and the first electric conductive elastic sheet 30 are separately arranged, in other words the second electric conductive elastic sheet 40 and the first electric conductive elastic sheet 30 are not integrally formed. The first electric conductive elastic sheet 30 and the second electric conductive elastic sheet 40 can be served to replace each other, and the material feature and the detailed structure of the second electric conductive elastic sheet 40 are the same as those of the first electric conductive elastic sheet 30. The second electric conductive elastic sheet 40 is accommodated in the other elastic sheet accommodating zone 15, and mainly has a fastening segment 41, a bending segment 42 extended from the fastening segment 41 and a clamping segment 43 extended from the bending segment 42, a through hole 411 is formed at the fastening segment 41, the through hole 411 is latched and positioned corresponding to the protrusion 232 and electrically connected to the electric conductive terminal 20, and the clamping segment 43 is formed at one side of the second lateral plate 212 and abutted against the latching block 216.

The pressing member 50 can be made of a material having an excellent insulating property and moveably connected to the base plate 11. The pressing member 50 mainly has an operation piece 51 and pushing units 52 extended from two sides of the operation piece 51, and an insertion slot 53 is formed between the pushing unit 52 and the operation piece 51. The insertion slot 53 is arranged corresponding to the insertion port 121, and the operation piece 51 is accommodated in the guide channel 13 and can be operationally displaced.

Furthermore, the dual-wire connector 1 provided by the present invention further includes a cover plate 60, and the cover plate 60 is sealed and engaged corresponding to the insulation base 10.

Figure 4:
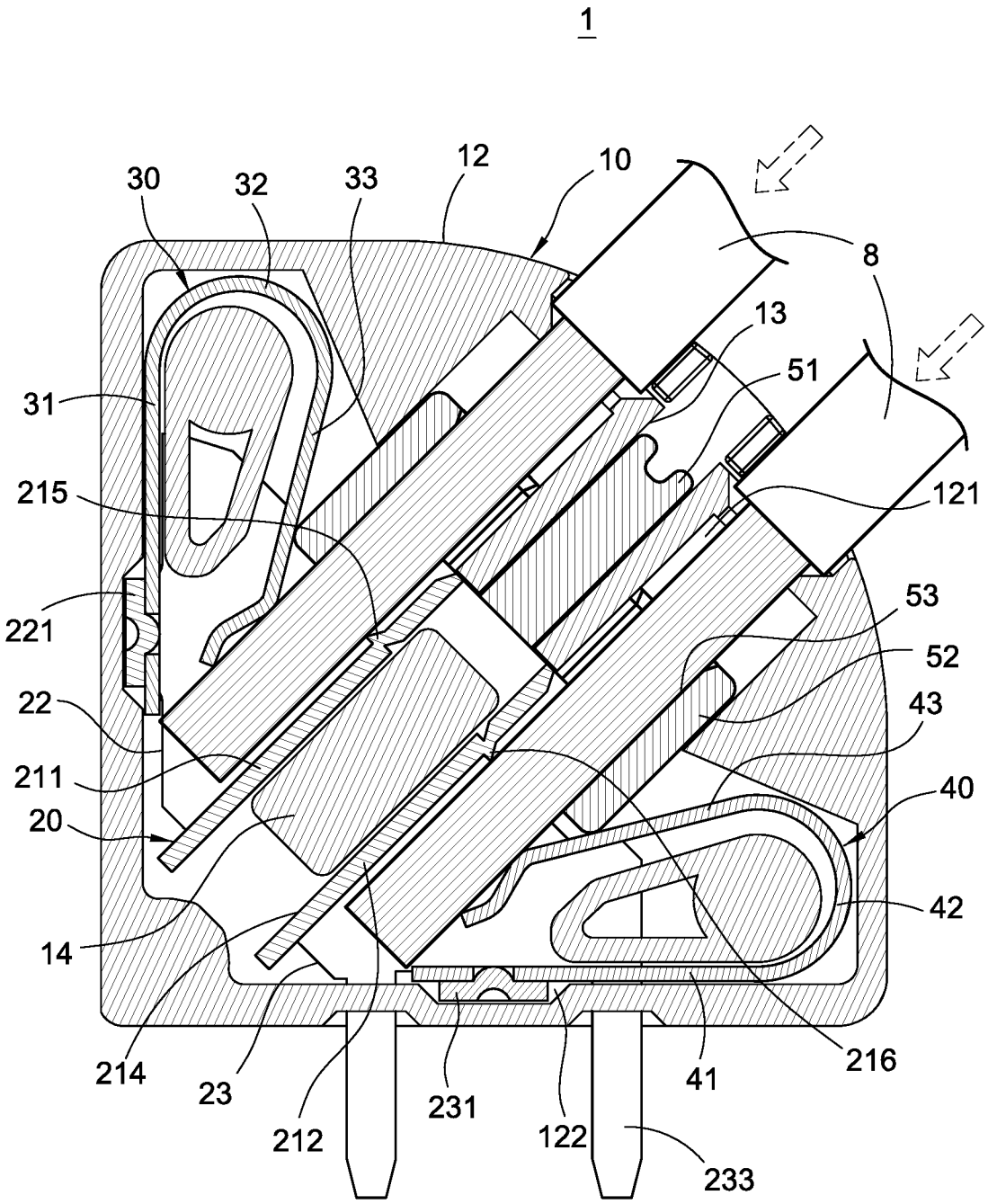
FIG. 4 is a cross sectional view showing one operating status of the dual-wire connector according one embodiment of the present invention.
Figure 5:
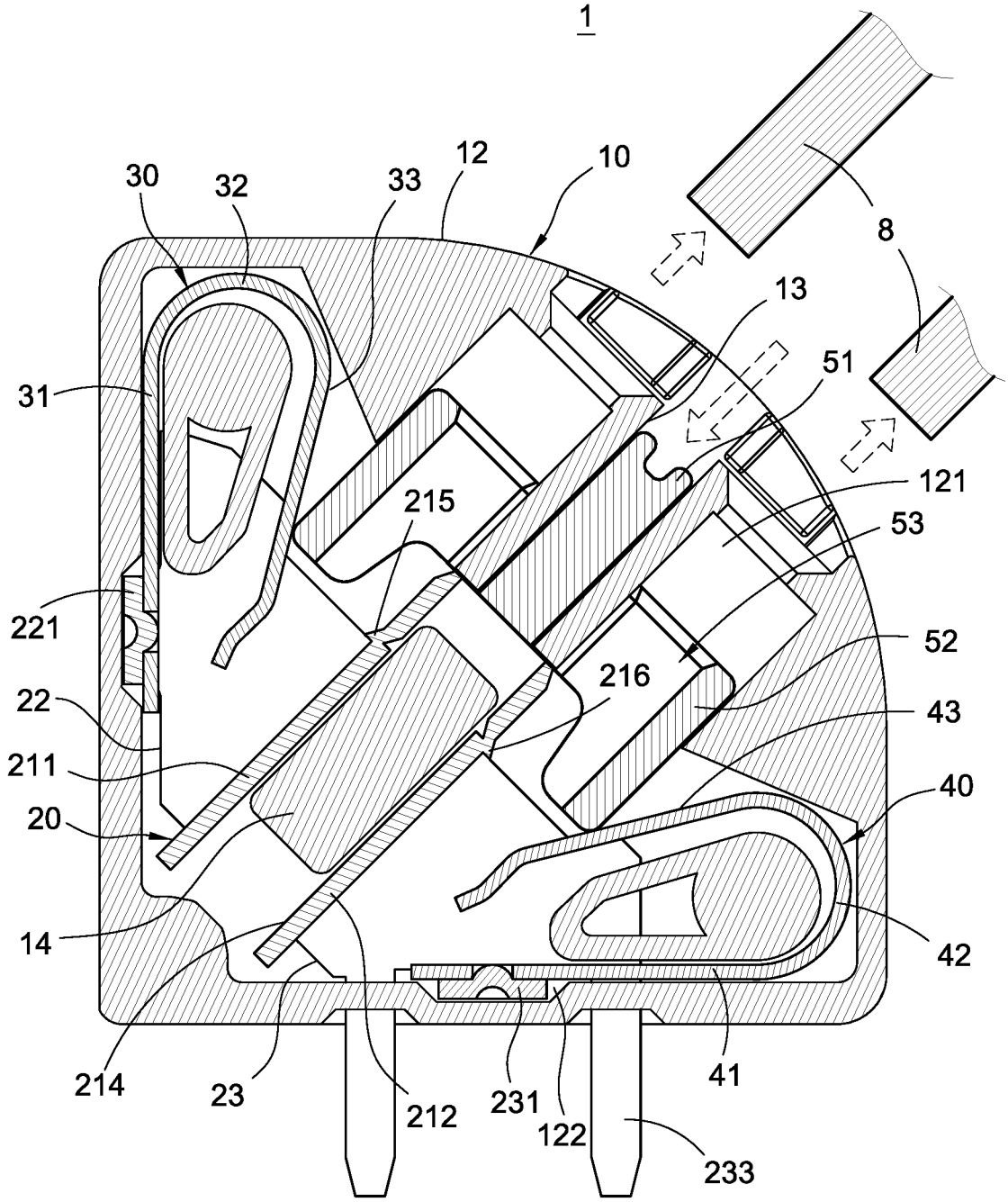
FIG. 5 is a cross sectional view showing another operating status of the dual-wire connector according one embodiment of the present invention.

Please refer to FIG. 4 and FIG. 5, when a wire connecting operation is desired to be processed, two wires 8 are inserted from the insertion ports 121, at this moment the wires 8 are allowed to pass the insertion slots 53, one of the wires 8 is clamped and fastened by the clamping segment 33 of the first electric conductive elastic sheet 30 and the first lateral plate 211 so as to be electrically conducted; the other wire 8 is clamped and fastened by the clamping segment 43 of the second electric conductive elastic sheet 40 and the second lateral plate 212 so as to be electrically conducted; with a fastening status provided by the clamping segments 33, 43 and the latching blocks 215, 216, a stable clamping effect can be formed. When a wire removing operation is desired to be processed, a hand tool, for example a screwdriver, is utilized for pressing the operation piece 51 so as to allow the operation piece 51 to be displaced, at this moment the clamping segments 33, 43 are pushed by the pushing units 52, so that the wires 8 can be released from the clamping segments 33, 43 and the latching blocks 215, 216, thereby allowing the wires 8 to be easily removed from the insertion slots 53 and the insertion ports 121.

Figure 6:
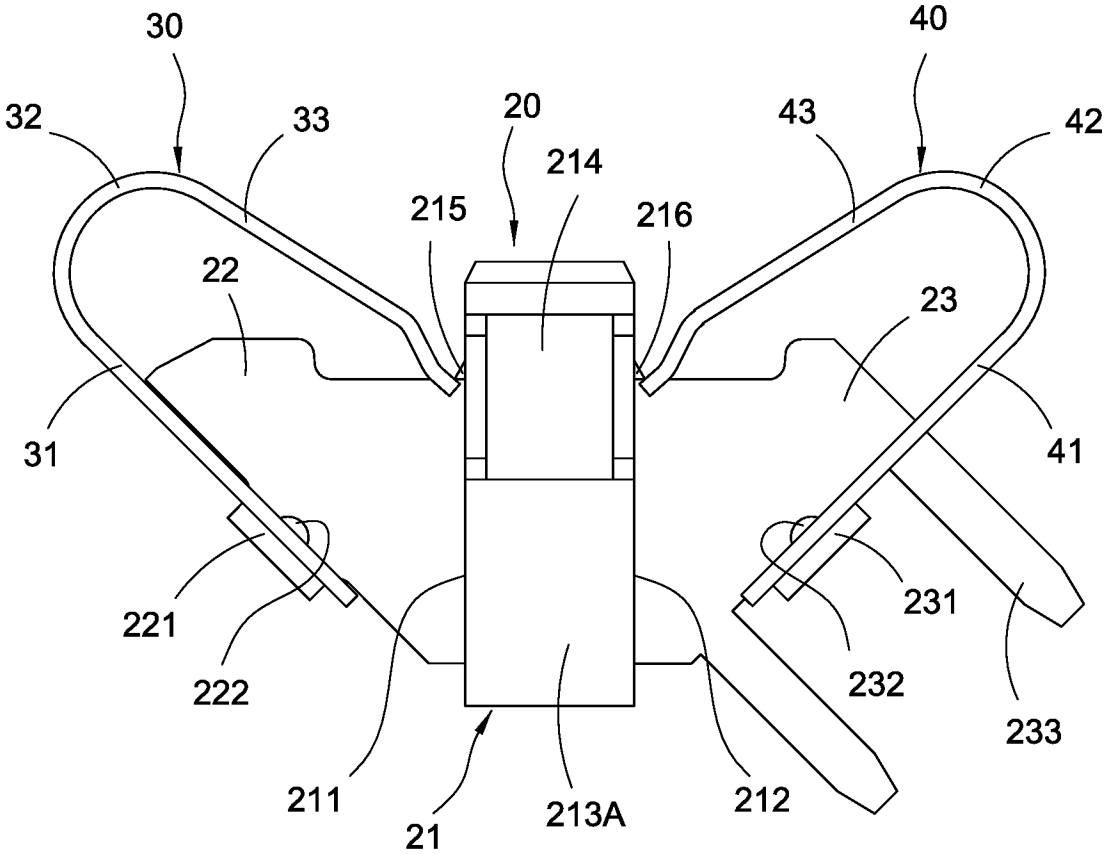
FIG. 6 is a schematic view showing the assembly of the electric conductive terminal and the electric conductive elastic sheets according another embodiment of the present invention.

Please refer to FIG. 6, which discloses another embodiment of the present invention; according to the another embodiment, the electric conductive terminal 20 can be provided with a widened connection plate 213A connected to the first lateral plate 211 and the second lateral plate 212, thereby being suitable to be applied in a larger current field.

Figure 7:
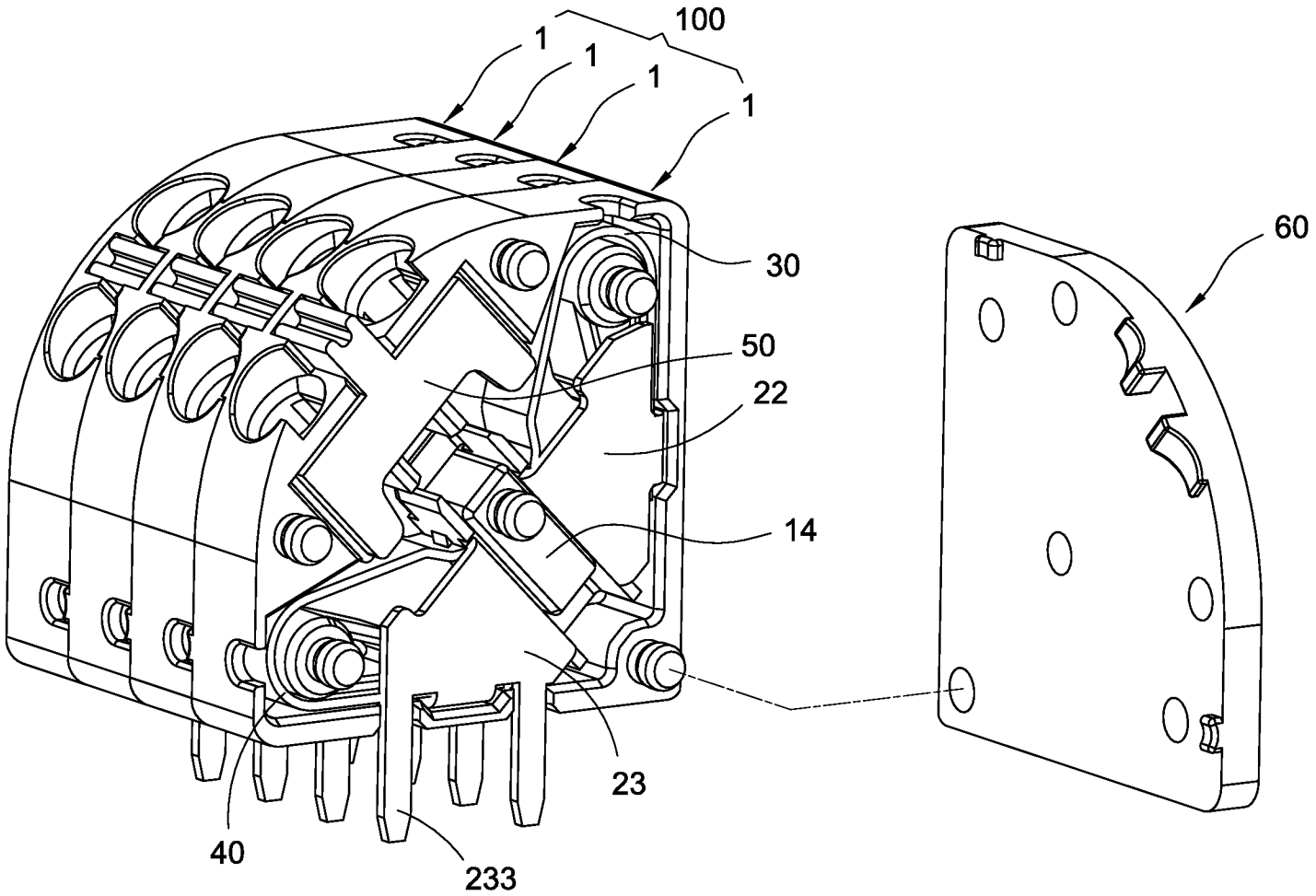
FIG. 7 is a schematic view showing an application assembly of the dual-wire connector according to the present invention.

Please refer to FIG. 7, in addition to there is only one dual-wire connector 1 to be adopted in the present invention, a plurality of the dual-wire connectors 1 can be arranged and assembled according to actual needs, so that a dual-wire connector assembly 100 can be formed.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A dual-wire connector (1), including:

an insulation base (10), having a base plate (11) and an enclosing plate (12) extended from the base plate (11), wherein two insertion ports (121) are formed on the enclosing plate (12);

an electric conductive terminal (20), fastened on the base plate (11), and having a first lateral plate (211) and a second lateral plate (212);

a first electric conductive elastic sheet (30), having a fastening segment (31) and a clamping segment (33), wherein the fastening segment (31) is electrically connected to the electric conductive terminal (20), and the clamping segment (33) is formed at one side of the first lateral plate (211);

a second electric conductive elastic sheet (40), separately arranged with respect to the first electric conductive elastic sheet (30) and having a fastening segment (41) and a clamping segment (43), wherein the fastening segment (41) is electrically connected to the electric conductive terminal (20), and the clamping segment (43) is formed at one side of the second lateral plate (212); and a pressing member (50), moveably connected to the base plate (11) and having insertion slots (53) corresponding the two insertion ports (121) and a pushing unit (52) formed at one side of the insertion slot (53), wherein through pressing the pressing member (50), the pushing units (52) are able to push and release the clamping segments (33, 43), wherein a fastening block (14) connected to the base plate (11) is formed on the insulation base (10), two sides of the fastening block (14) are formed with an elastic sheet accommodating zone (15), and the first electric conductive elastic sheet (30) and the second electric conductive elastic sheet (40) are accommodated in the elastic sheet accommodating zones (15).

2. The dual-wire connector (1) according to claim 1, wherein the first electric conductive elastic sheet (30) and the second electric conductive elastic sheet (40) are detachably connected to the electric conductive terminal (20).

3. The dual-wire connector (1) according to claim 1, wherein the electric conductive terminal (20) includes a seat member (21), a left planar plate (22) and a right planar plate (23), the first lateral plate (211) and the second lateral plate (212) are formed on the seat member (21), the left planar plate (22) is formed through being extended from the first lateral plate (211), and the right planar plate (23) is formed through being extended from the second planar plate (212).

4. The dual-wire connector (1) according to claim 3, wherein two mounting slots (122) are formed on the enclosing plate (12), a left mounting block (221) is bent and extended from the left planar plate (22), a right mounting block (231) is bent and extended from the right planar plate (23), the left mounting block (221) is mounted and positioned corresponding to one of the mounting slots (122), and the right mounting block (231) is mounted and positioned corresponding to the other mounting slot (122).

5. The dual-wire connector (1) according to claim 4, wherein a protrusion (222) is formed on the left mounting block (221), the fastening segment (31) of the first electric conductive elastic sheet (30) is formed with a through hole (311), and the through hole (311) is latched and positioned corresponding to the protrusion (222) of the left mounting block (221).

6. The dual-wire connector (1) according to claim 4, wherein a protrusion (232) is formed on the right mounting block (231), the fastening segment (41) of the second electric conductive elastic sheet (40) is formed with a through hole (411), and the through hole (411) is latched and positioned corresponding to the protrusion (232) of the right mounting block (231).

7. The dual-wire connector (1) according to claim 3, wherein two penetrated slots (123) are formed on the enclosing plate (12), two insertion pins (233) are extended from the right planar plate (23), and the insertion pins (233) are protruded from the penetrated slots (123) so as to be exposed outside the insulation base (10).

8. The dual-wire connector (1) according to claim 1, wherein the electric conductive terminal (20) includes a seat member (21), the first lateral plate (211) and the second lateral plate (212) formed on the seat member (21), and the seat member (21) further includes a connection plate (213) used for connecting the first lateral plate (211) and the second lateral plate (212), a through slot (214) is formed on the connection plate (213), and the through slot (214) is sleeved and fastened corresponding to the fastening block (14).

9. The dual-wire connector (1) according to claim 8, wherein the connection plate (213) is a widened connection plate.

10. The dual-wire connector (1) according to claim 1, wherein the first electric conductive elastic sheet (30) is connected to the fastening segment (31) and the clamping segment (33) via a bending segment (32), a latching block (215) is formed on the first lateral plate (211), and the clamping segment (33) of the first electric conductive elastic sheet (30) is abutted against the latching block (215) of the first lateral plate (211).

11. The dual-wire connector (1) according to claim 1, wherein the second electric conductive elastic sheet (40) is connected to the fastening segment (41) and the clamping segment (43) via a bending segment (42), a latching block (216) is formed on the second lateral plate (212), and the clamping segment (43) of the second electric conductive elastic sheet (40) is abutted against the latching block (216) of the second lateral plate (212).

12. A dual-wire connector (1), including:

an insulation base (10), having a base plate (11) and an enclosing plate (12) extended from the base plate (11), wherein two insertion ports (121) are formed on the enclosing plate (12);

an electric conductive terminal (20), fastened on the base plate (11), and having a first lateral plate (211) and a second lateral plate (212);

a first electric conductive elastic sheet (30), having a fastening segment (31) and a clamping segment (33), wherein the fastening segment (31) is electrically connected to the electric conductive terminal (20), and the clamping segment (33) is formed at one side of the first lateral plate (211);

a second electric conductive elastic sheet (40), separately arranged with respect to the first electric conductive elastic sheet (30) and having a fastening segment (41) and a clamping segment (43), wherein the fastening segment (41) is electrically connected to the electric conductive terminal (20), and the clamping segment (43) is formed at one side of the second lateral plate (212); and a pressing member (50), moveably connected to the base plate (11) and having insertion slots (53) corresponding the two insertion ports (121) and a pushing unit (52) formed at one side of the insertion slot (53), wherein through pressing the pressing member (50), the pushing units (52) are able to push and release the clamping segments (33, 43), wherein a guide channel (13) is formed between the insertion ports (121), the pressing member (50) further has an operation piece (51) connected to the pushing units (52), the insertion slots (53) are formed between the pushing units (52) and the operation piece (51), and the operation piece (51) is accommodated in the guide channel (13) and capable of being operationally displaced.

13. The dual-wire connector (1) according to claim 1, further including a cover plate (60), and the cover plate (60) is sealed and engaged corresponding to the insulation base (10).

* * * * *